US007524193B2

(12) United States Patent
Hashiguchi et al.

(10) Patent No.: US 7,524,193 B2
(45) Date of Patent: Apr. 28, 2009

(54) CONNECTOR EXCELLENT IN HIGH-FREQUENCY CHARACTERISTICS

(75) Inventors: Osamu Hashiguchi, Tokyo (JP); Yuta Takimura, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 12/001,356

(22) Filed: Dec. 11, 2007

(65) Prior Publication Data

US 2008/0146049 A1 Jun. 19, 2008

(30) Foreign Application Priority Data

Dec. 19, 2006 (JP) ..... 2006-341710
Jun. 27, 2007 (JP) ..... 2007-169690

(51) Int. Cl.
*H01R 12/00* (2006.01)

(52) U.S. Cl. ..... 439/65

(58) Field of Classification Search ..... 439/108, 439/608, 65

See application file for complete search history.

(56) References Cited

U.S. PATENT DOCUMENTS 4,705,332 A * 11/1987 Sadigh-Behzadi ..... 439/69
5,522,727 A * 6/1996 Saito et al. ..... 439/65
5,637,014 A * 6/1997 Sukegawa et al. ..... 439/607
6,902,433 B1 6/2005 Hashimoto et al.

FOREIGN PATENT DOCUMENTS

| | | |
|---|---|---|
| JP | 4-008382 | 1/1992 |
| JP | 2623435 | 3/1995 |
| JP | 2000-242381 | 9/2000 |
| JP | 2001-250612 | 9/2001 |
| JP | 2005-293970 | 10/2005 |

OTHER PUBLICATIONS

Japanese Office Action dated Nov. 12, 2008 in Japanese Application No. 2007-169690.

* cited by examiner

*Primary Examiner*—Tho D Ta
*Assistant Examiner*—Travis Chambers
(74) *Attorney, Agent, or Firm*—Collard & Roe, P.C.

(57) ABSTRACT

In a connector for connecting two connection objects, a connection member is coupled to a housing which holds contacts to be connected to one of the connection objects. The connection member includes a plurality of terminals to be connected to the other connection object. The connection member further includes a plurality of first conductor patterns arranged in parallel to one another and a plurality of second conductor patterns intersecting the first conductor patterns and arranged in parallel to one another. The first and the second conductor patterns are successively layered at positions different from one another. The first conductor patterns have one ends connected to the contacts and the other ends connected to one ends of the second conductor patterns. The second conductor patterns have the other ends connected to the terminals.

9 Claims, 10 Drawing Sheets

| PIN | SIGNAL |
|---|---|
| 2 | T.M.D.S. Data2 Shield |
| 4 | T.M.D.S. Data1+ |
| 6 | T.M.D.S. Data1- |
| 8 | T.M.D.S. Data0 Shield |
| 10 | T.M.D.S. Clock+ |
| 12 | T.M.D.S. Clock- |
| 14 | Reserve2 |
| 16 | DDC Data |
| 18 | +5V Power |

| PIN | SIGNAL |
|---|---|
| 1 | T.M.D.S. Data2+ |
| 3 | T.M.D.S. Data2- |
| 5 | T.M.D.S. Data1 Shield |
| 7 | T.M.D.S. Data0+ |
| 9 | T.M.D.S. Data0- |
| 11 | T.M.D.S. Clock Shield |
| 13 | CEC |
| 15 | DDC Clock |
| 17 | Ground (for +5V) |
| 19 | Hot Plug Detect |

FIG. 6

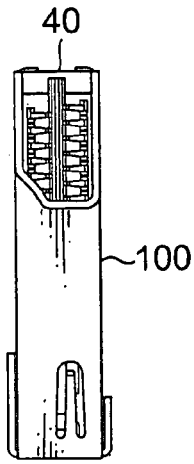
FIG. 9D
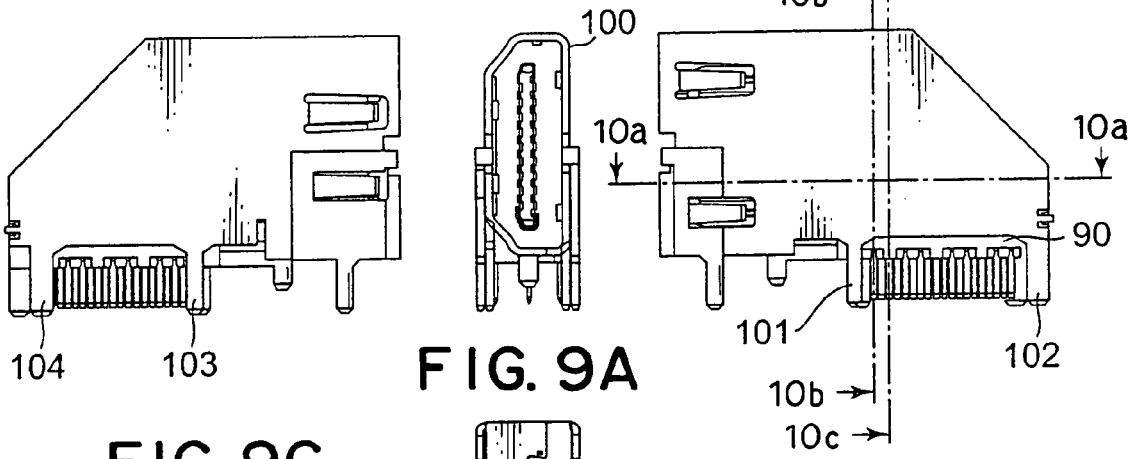
FIG. 9A
FIG. 9C
FIG. 9B
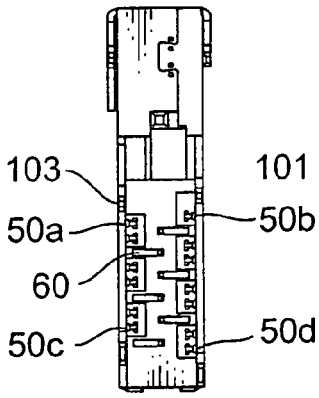
FIG. 9E

CONNECTOR EXCELLENT IN HIGH-FREQUENCY CHARACTERISTICS

This application is based upon and claims the benefit of priority from Japanese patent application No. 2006-341710, filed on Dec. 19, 2006, and Japanese patent application No. 2007-169690, filed on Jun. 27, 2007, the disclosures of which are incorporated herein in their entirety by reference.

BACKGROUND OF THE INVENTION

This invention relates to a connector, such as an angle connector, for connecting two connection objects to each other.

A connector of the type is disclosed, for example, in Japanese Patent (JP-B) No. 2623435 as "Equal-Length Right Angle Connector". The connector has a substrate comprising three insulating plates layered on one another. The substrate has a plurality of signaling through holes and a plurality of grounding through holes. The signaling through holes and the grounding through holes are subjected to plating.

Among the three insulating plates, the center insulating plate has a plurality of signal patterns (conductor patterns) formed on opposite surfaces thereof. The signal patterns on the opposite surfaces are electrically connected to each other through the signaling through holes. Each of the other insulating plates on opposite sides of the center insulating plate has a plurality of ground conductor patterns formed on an outer surface thereof. The ground conductor patterns on the other insulating plates are electrically connected to each other through the grounding through holes.

Some of the signaling through holes receive signal pin contacts fitted thereto. The grounding through holes receive ground pin contacts fitted thereto.

SUMMARY OF THE INVENTION

In the above-mentioned connector, the signal conductor patterns are formed on the opposite surfaces of the center insulating plate while the ground conductor patterns are formed on the outer surfaces of the other insulating plates on the opposite sides of the center insulating plate. With this structure, it is possible to make wirings on the substrate have lengths which are equal to one another. However, it is difficult to achieve a high-density of the wirings on the substrate and a compact connector.

It is therefore an exemplary object of this invention to provide a connector which is capable of achieving equal-length wiring and a high-density substrate.

It is another exemplary object of this invention to provide a compact connector excellent in high-frequency characteristics adaptable to a digital transmission system such as TMDS (transition minimized differential signaling).

Other objects of the present invention will become clear as the description proceeds.

According to an exemplary aspect of the present invention, there is provide a connector for connecting two connection objects, the connector comprising a plurality of contacts to be connected to one of the connection objects, a housing holding the contacts, and a connection member coupled to the housing and including a plurality of terminals to be connected to the other connection object, the connection member further including a plurality of first conductor patterns arranged in parallel to one another and a plurality of second conductor patterns intersecting the first conductor patterns and arranged in parallel to one another, the first and the second conductor patterns being successively layered at positions different from one another, the first conductor patterns having one ends connected to the contacts and another ends connected to one ends of the second conductor patterns, the second conductor patterns having the other ends connected to the terminals.

BRIEF DESCRIPTION OF THE DRAWING

FIG. 6 is a view for describing pin assignment of a HDMI (high definition multimedia interface);

FIGS. 9A to 9E are a side view, a rear view, a front view, a plan view, and a bottom view of a connector according to a third exemplary embodiment of this invention, respectively.

DESCRIPTION OF THE EXEMPLARY EMBODIMENTS

Figure 1D:
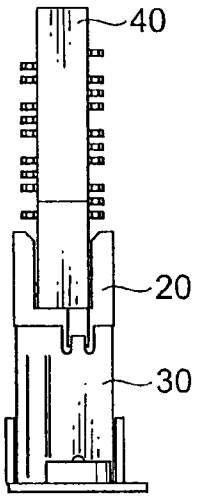
FIGS. 1A to 1D are a front view, a side view, a rear view, and a plan view of a connector according to a first exemplary embodiment of this invention, respectively.
Figure 1B:
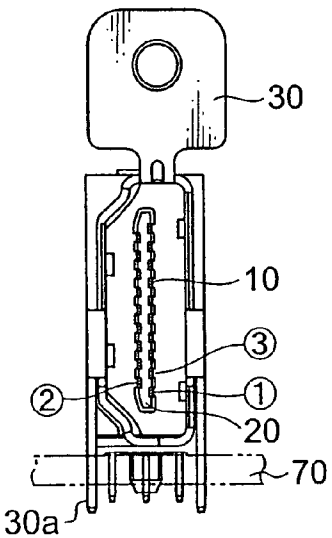
Figure 1C:
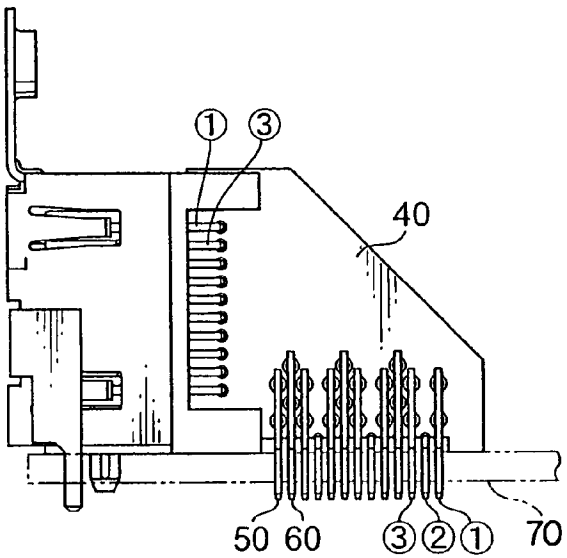
Figure 1A:
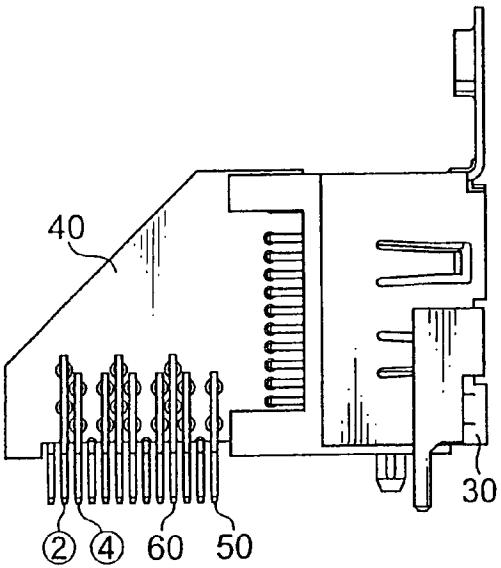

At first referring to FIGS. 1A to 6, a connector according to a first exemplary embodiment of this invention will be described.

The connector comprises a plurality of contacts 10, an insulator (housing) 20 holding the contacts 10, and a shell 30 covering the contacts 10 and the insulator 20. The connector incorporates or contains, as a connection member, an internal substrate 40 having a plurality of terminals 50 and 60. The terminals 50 and 60 of the internal substrate 40 are connected to a mounting substrate 70. The shell 30 has a pair of shell terminals 30*a* to be connected to the mounting substrate 70. The internal substrate 40 is equivalent to a substrate comprising two substrates adhered to each other as described in JP 2623435 B.

The contacts 10 are assembled to the insulator 20 to be arranged in two rows on both sides of the insulator 20 at a fitting opening of the shell 30. The contacts 10 are connected to the internal substrate 40 by SMT (surface mount technology) insertion known in the art. The terminals 50 and 60 are fixed to the internal substrate 40 by being press-fitted in through holes of the internal substrate 40. Alternatively, the terminals 50 and 60 may be electrically connected to the internal substrate 40 by soldering.

The terminals 50 and 60 are inserted into through holes of the mounting substrate 70 and electrically connected to a pattern (not shown) of the mounting substrate 70 by soldering. Alternatively, the terminals 50 and 60 are electrically connected to the pattern (not shown) of the mounting substrate 70 by SMT.

FIG. 6 shows pin assignment of a HDMI (high definition multimedia interface). For example, terminals 1, 2, and 3 are assigned with "Data 2+", "Data 2 shield", and "Data 2−" of TMDS, respectively. In a transmission lines, the terminals 1 ("Data 2+") and 3 ("Data 2−") are preferably arranged at positions at equal distances from the terminal 2 ("Data 2 shield"). In FIGS. 1A to 5, the terminals 1 to 3 are depicted by encircled numbers (encircled 1, encircled 2, encircled 3), respectively.

Figure 3A:
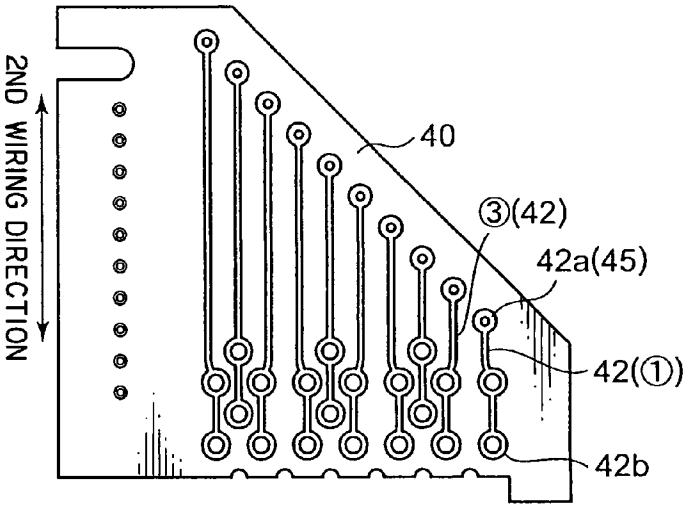
FIGS. 3A to 3D are sectional views taken along lines 3*a*-3*a*, 3*b*-3*b*, 3*c*-3*c*, and 3*d*-3*d* in FIG. 2B, respectively.
Figure 3B:
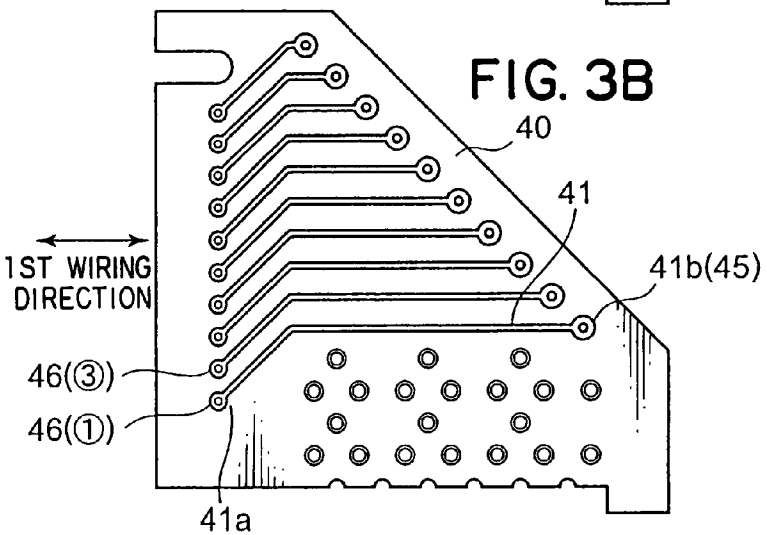

As shown in FIG. 3A, the internal substrate 40 has a first layer provided with a plurality of conductor patterns 41 different in length from one another and extending in parallel to one another. As shown in FIG. 3B, the internal substrate 40 has a second layer provided with a plurality of second conductor patterns 42 different in length from one another. The second conductor patterns 42 extend from terminating ends 41*b* of the first conductor patterns 41 to be parallel to one another and to be perpendicular to the first conductor patterns 41. The first conductor patterns 41 and the second conductor patterns 42 are equal in number to each other. Each of the second conductor patterns 42 has a starting end 42*a* provided with a through hole 45 subjected to plating. Similarly, the terminating end 41*b* of each of the first conductor patterns 41 is provided with a similar through hole 45 subjected to plating. The through holes 45 are electrically connected to each other.

Figure 3C:
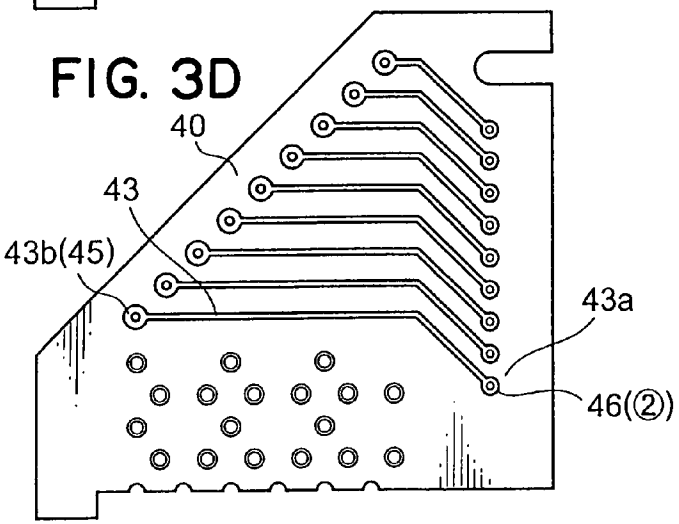
Figure 3D:
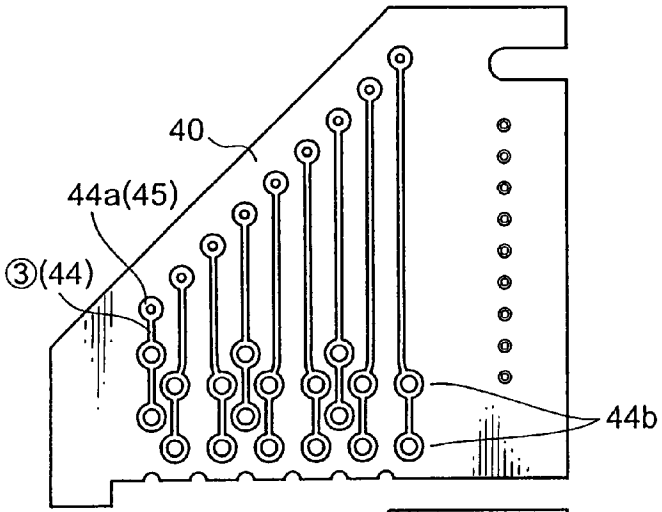

As shown in FIGS. 3C and 3D, the internal substrate 40 has third and fourth layers provided with a plurality of third conductor patterns 43 and a plurality of fourth conductor patterns 44 like the first and the second conductor patterns 41 and 42. As shown in FIGS. 3A and 3C, the first and the third conductor patterns 41 and 43 are disposed at positions different from each other in a direction perpendicular to a wiring direction. As shown in FIGS. 3B and 3D, the second and the fourth conductor patterns 42 and 44 are disposed at positions different from each other in a direction perpendicular to a wiring direction.

Figure 4A:
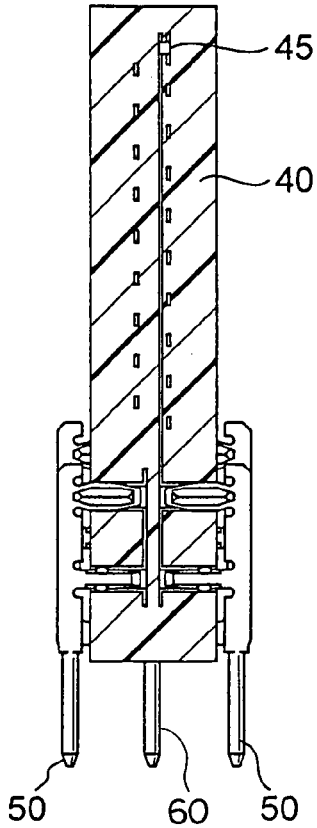
FIGS. 4A to 4C are sectional views taken along lines 4*a*-4*a*, 4*b*-4*b*, and 4*c*-4*c* in FIG. 2C, respectively, FIGS. 4A and 4B showing a state where terminals are fixed.
Figure 4B:
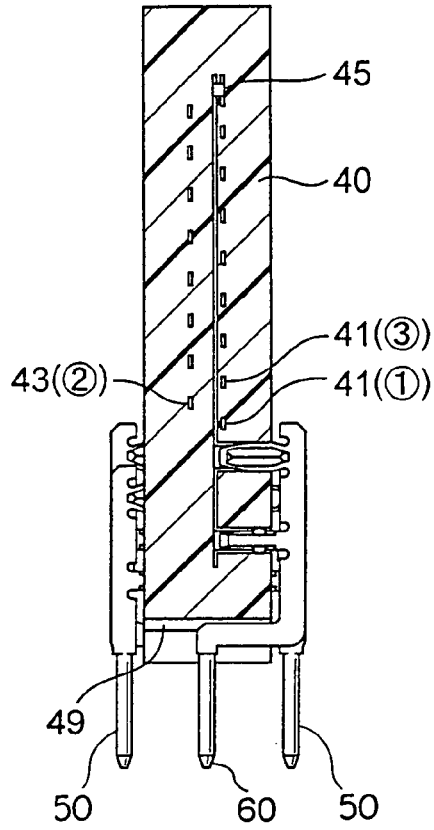
Figure 4C:
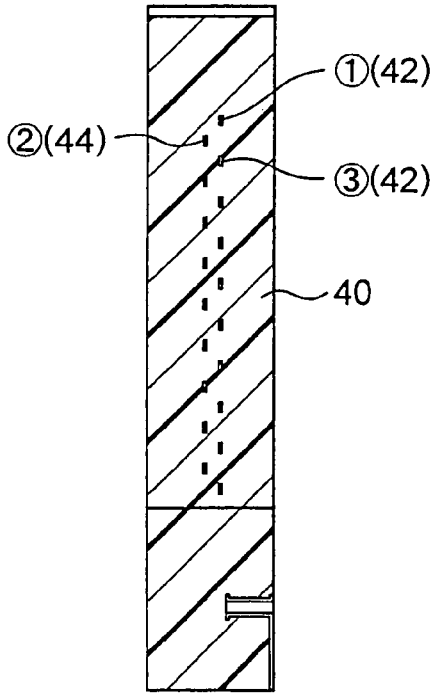
Figure 5A:
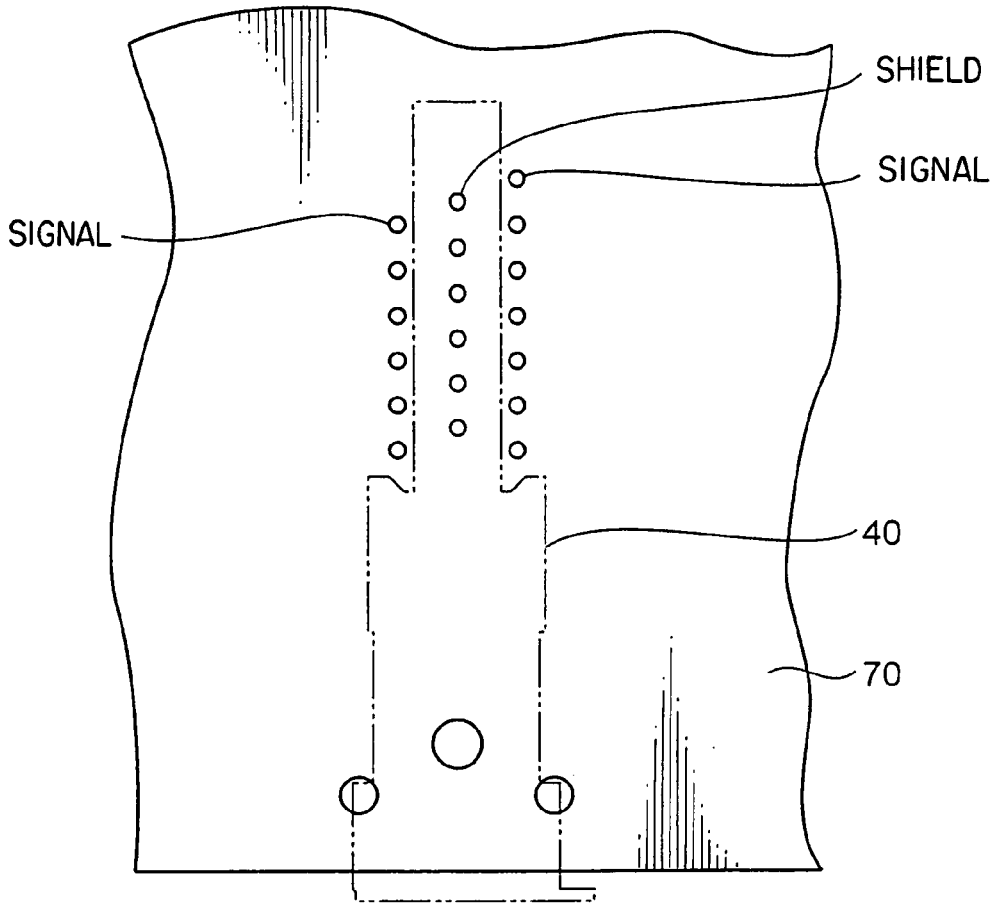
FIG. 5A is a view for describing an arrangement of a plurality of contacts (pins) of the connector in FIGS. 1A to 1D with respect to a mounting substrate.
Figure 5B:
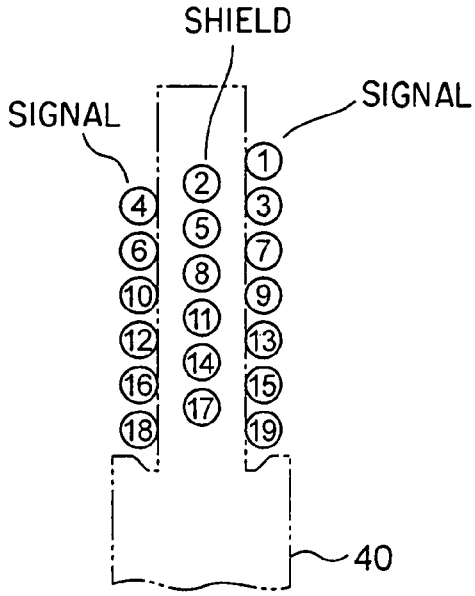
FIG. 5B is a view for describing an arrangement of the contacts with respect to an insulator.

As shown in FIG. 4B, the terminal 2 (depicted by the encircled 2) of the third conductor pattern 43 is located vertically between the terminals 1 and 3 (depicted by the encircled 1 and the encircled 3) adjacent to each other in the first conductor pattern 41. As shown in FIG. 4C, the terminal 2 (depicted by the encircled 2) of the fourth conductor pattern 44 is located vertically between the terminals 1 and 3 (depicted by the encircled 1 and the encircled 3) adjacent to each other in the second conductor pattern 42.

To the terminating ends 42*b* of the second conductor patterns 42, the terminals 50 and 60 for connection with the mounting substrate 70 are electrically connected and fixed. Some of the terminals 60 are bent in a crank-like shape (see FIG. 4B) in a thickness direction of the internal substrate 40 to be decentered and disposed at a center row in FIGS. 5A and 5B. Therefore, connection with wiring patterns of the mounting board 70 is facilitated.

Figures 2A, 2B, 2C, 2D:
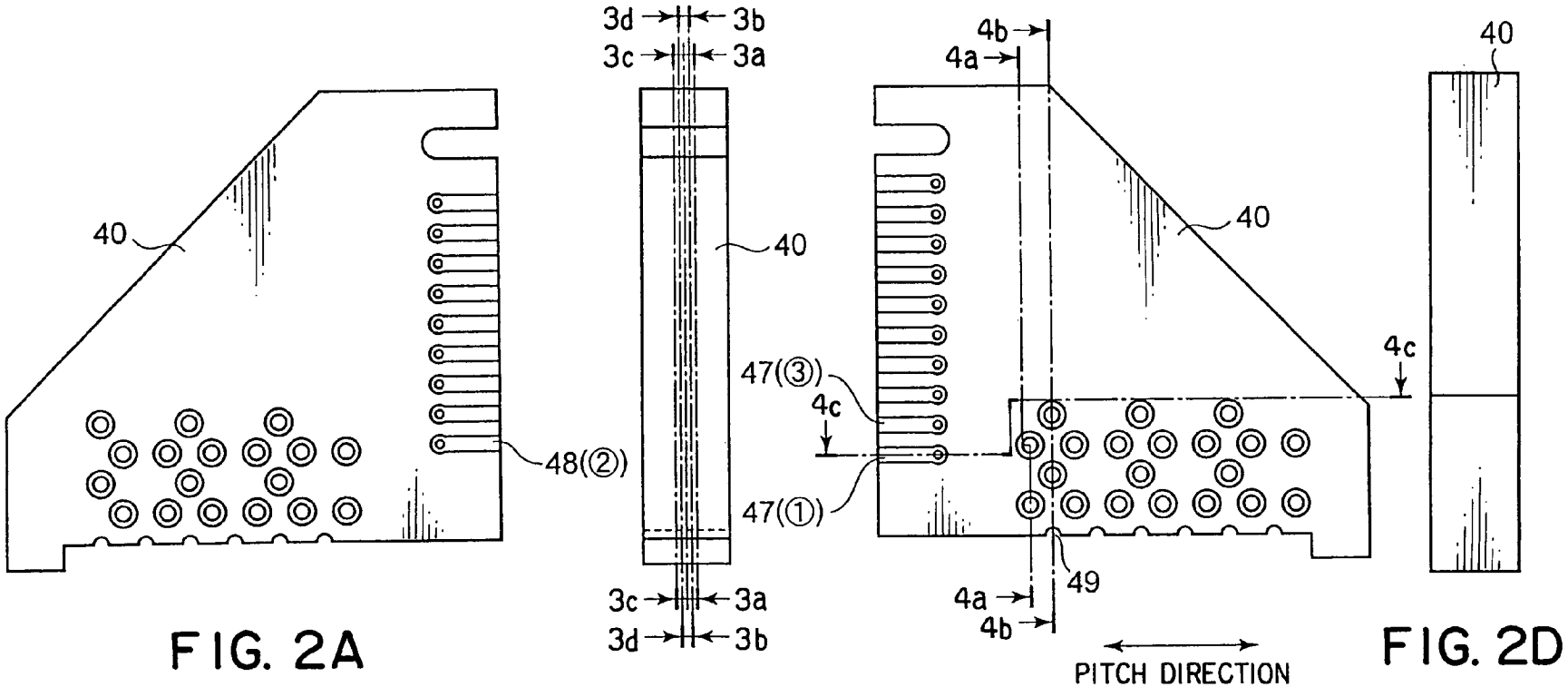
FIGS. 2A to 2D are a front view, a side view, a rear view, and a plan view of an internal substrate incorporated in the connector illustrated in FIGS. 1A to 1D, respectively.

At a lower part of the internal substrate 40, a plurality of semicircular grooves (positioning portions) 49 are formed as illustrated in FIG. 2C and so on. Each groove 49 serves to prevent each terminal 60 from wobbling. By fitting an intermediate portion of the terminal 60 into the groove 49, the terminal 60 is positioned with respect to the internal substrate 40 and connection with the mounting substrate 70 is facilitated.

The transmission lines (signals) connected to the terminals 50 are equal in length to one another. The transmissions line (shield and others) connected to the terminals 60 are slightly longer than the transmission lines connected to the terminals 50, because they are bent in a crank-like shape.

As illustrated in FIGS. 4B and 4C, the two signal contacts 1 and 3 (depicted by the encircled 1 and 3) and the one ground contact 2 (depicted by the encircled 2) are arranged at apexes of a triangle. Therefore, excellent high-frequency characteristics are obtained. Further, by adjusting the width of each conductor pattern, characteristic impedances can be set at a predetermined level.

Referring to FIGS. 7A to 8C, a connector according to a second exemplary embodiment of this invention will be described. Similar parts are designated by like reference numerals and description thereof will be omitted.

Figure 8A:
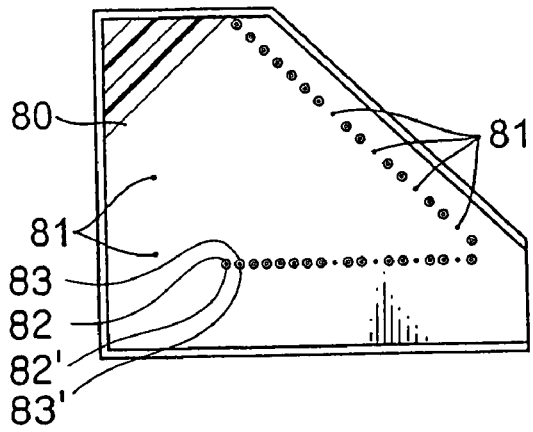
FIGS. 8A to 8C are sectional views taken along lines 8*a*-8*a*, 8*b*-8*b*, and 8*c*-8*c* in FIGS. 7A and 7B, respectively, FIGS. 8A and 8B being hatched only partially for convenience of illustration.
Figure 8B:
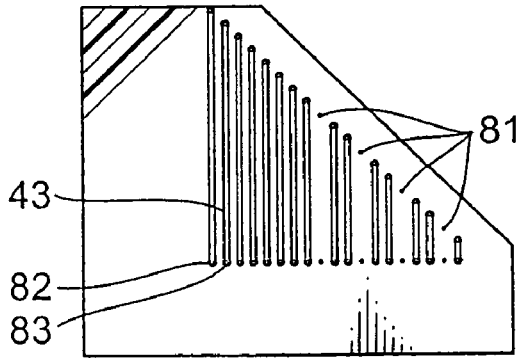
Figure 8C:
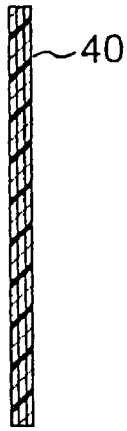
Figure 10A:
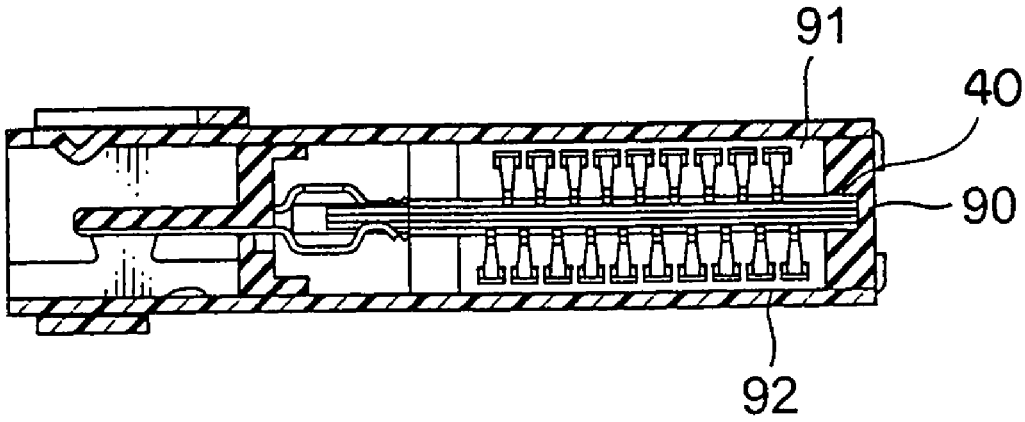
FIGS. 10A to 10C are sectional views taken along lines 10*a*-10*a*, 10*b*-10*b*, and 10*c*-10*c* in FIGS. 9A to 9E, respectively.
Figure 10B:
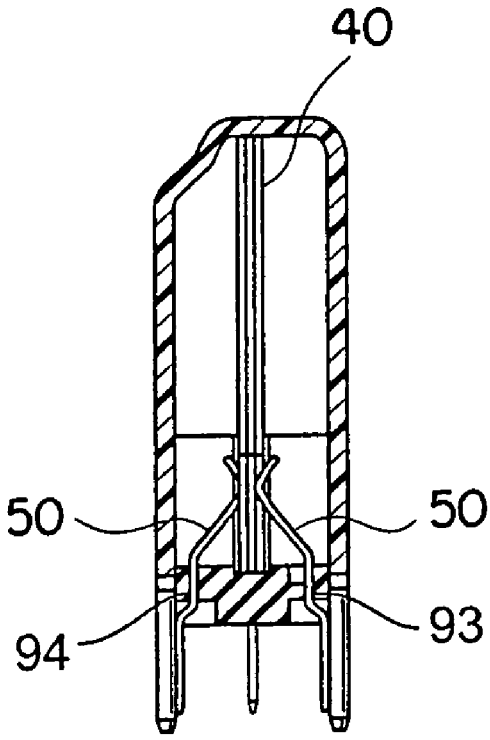
Figure 10C:
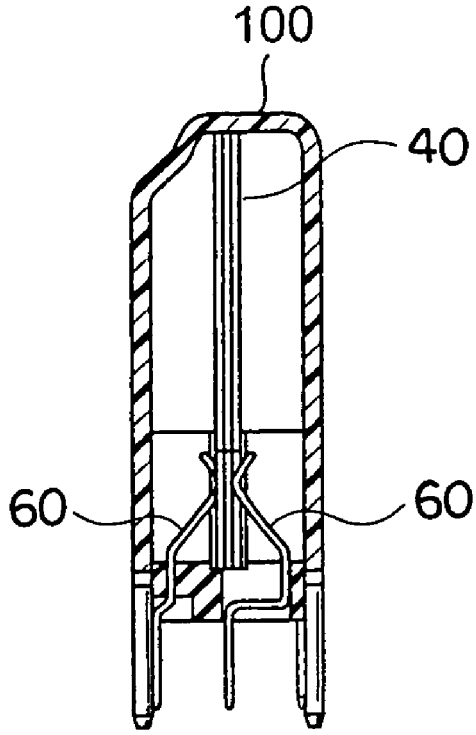

In the connector, the second layer having the second conductor patterns 42 of the connector according to the first exemplary embodiment comprises a ground plate 80 as shown in FIG. 8A. Ground terminals are electrically connected to the ground plate 80 via through holes 81. However, no patterned wiring is formed.

Figures 7A, 7B, 7C:
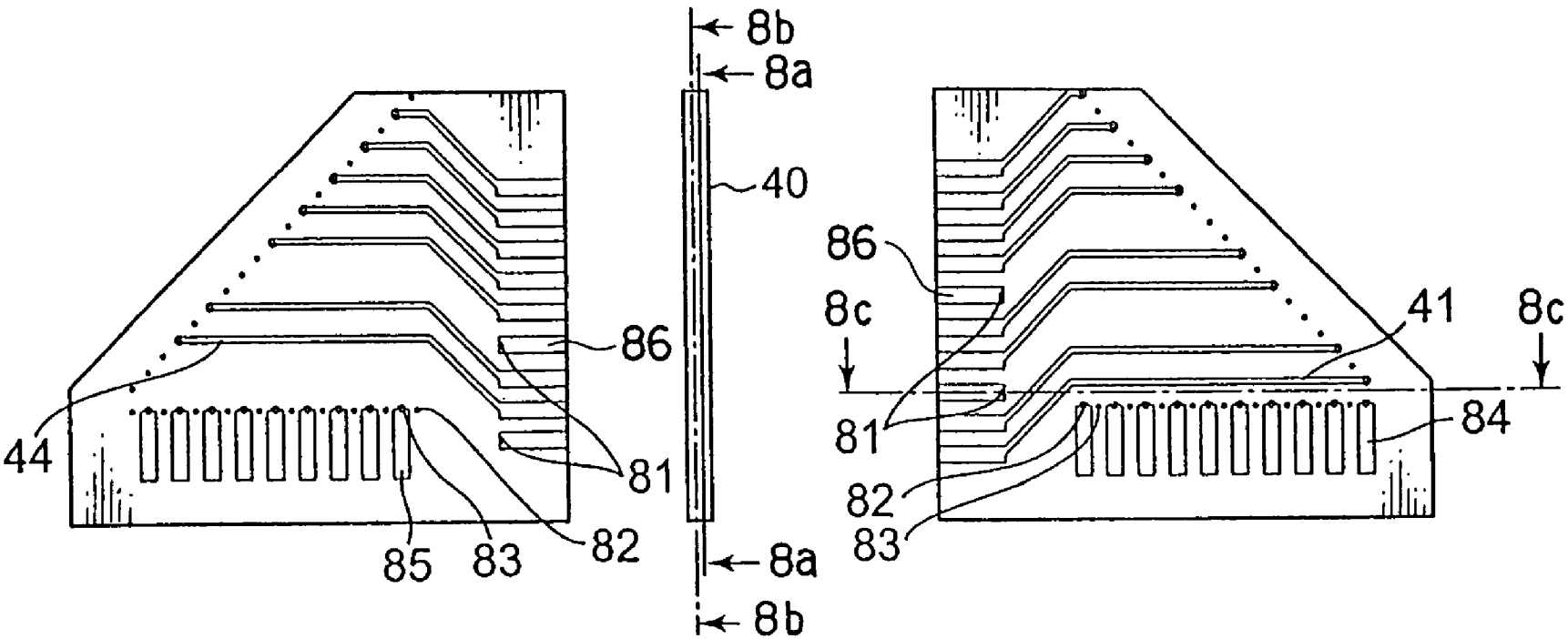
FIGS. 7A to 7C are a side view, a front view, and a rear view of an internal substrate of a connector according to a second exemplary embodiment of this invention, respectively.

A surface layer shown in FIG. 7B and a back layer shown in FIG. 7C are provided with a plurality of pads (terminals) 84 and 85, respectively. The pads 84 and 85 are easy in impedance matching upon connection with the terminals 50 and 60 for connection with the mounting substrate 70. These pads 84 and 85 are connected via through hole plating layers 82 and 83 to inner layers illustrated in FIG. 8A and 8B. A plurality of pads 86 shown in FIGS. 7B and 7C are connected to the ground plate 80 in FIG. 8A via the through hole plating layers 82 and 83. Escape portions 82' and 83' in FIG. 8A serve to prevent connection between the ground plate 80 and the through hole plating layers 82 and 83.

In the above-mentioned connector, the ground plate 80 is wide. Therefore, a ground inductance known in the art is decreased and a sufficient return path is obtained so that the high-frequency characteristics are further improved. In addition, since there is no patterned wiring for the ground, positions of ground pads known in the art can freely be selected by preparing a substrate with different positions of the through holes 81. Accordingly, the number of options of pin assignment of the mounting substrate 70 is increased.

Further, the terminals 50 and 60 for connection with the mounting substrate 70 are held by the insulator as a separate component. Therefore, the internal substrate (connection member) 40 need not be subjected to a processing operation, which might disturb electric performances, for the purpose of holding the terminals 50 and 60. Accordingly, the thickness of the internal substrate 40 can be reduced. As compared with the case where the terminals 50 and 60 for connection are held on the internal substrate 40 by press-fitting or the like, coplanarity is improved.

The ground plate 80 covering a substantially entire area of one of the layers of the internal substrate 40 is provided on at least one of the layer having the second conductor patterns 42 and the layer having the third conductor patterns 43. The ground plate 80 may be connected to the ground patterns that are included in the first through the fourth conductor patterns 41 to 44.

Referring to FIGS. 9A to 10C, a connector according to a third exemplary embodiment of this invention will be described. Similar parts are designated by like reference numerals and description thereof will be omitted.

In the above-mentioned connector, the terminals 50 and 60 for connection with the mounting substrate 70 (FIG. 1B and 1C) are held by an insulator 90 as a separate component. The terminals 50 for connection are disposed so as to sandwich the internal substrate 40, and held by holding portions 93 and 94 of the insulator 90. A shell 100 is extended along upper and lower surfaces 91 and 92 of the insulator 90. The shell 100 substantially entirely covers the internal substrate 40. Adjacent to opposite ends of the terminals 50 for connection, shell mounting terminals 101 to 104 are disposed.

In the above-mentioned connector, the holding portions 93 and 94 of the terminals 50 for connection are arranged in the thickness direction of the internal substrate 40. Therefore, high-frequency characteristics such as cross-talk characteristics become excellent. The shell 100 can be extended along the insulator 90. Therefore, by disposing the shell mounting terminals 101 to 104 adjacent to the terminals 50*a* to 50*d* for connection, all of the terminals 50 for connection are put into the same condition in terms of high frequency. (The characteristic impedance is different depending upon whether metal terminals are present or absent on both adjacent sides.) Further, by covering the most part of the internal substrate 40 with the shell 100, unnecessary radiation can be suppressed.

By the above-mentioned various connectors, the following effects are expected.

1. It is possible to provide a connector excellent in high-frequency characteristics adaptable to a digital transmission system such as TMDS.

2. It is possible to improve EMI characteristics because the shell covers the housing and has shell terminals connected to the other of the connection objects.

3. It is possible to achieve a high density of the connection member because the terminals of the connection member to be connected to the other connection object are arranged in three rows in a layered direction of the first through the fourth conductor patterns.

4. The connection member is easily connected to the other connection object because, among the terminals of the connection member, the terminals in the center row are positioned by the positioning portions of the connection member in a pitch direction perpendicular to the layered direction.

5. The connection member is compact.

6. It is possible to obtain a connector in which the conductor patterns between the contacts and the terminals are equal in length to one another.

7. The high-frequency characteristics are further improved because the ground layer covers an entire area of one layer of the connection member.

In addition, various exemplary embodiments of this invention will be enumerated below.

1. A connector for connecting two connection objects, the connector comprising:

a plurality of contacts 10 to be connected to one of the connection objects;

a housing 20 holding the contacts; and a connection member 40 coupled to the housing 20 and including a plurality of terminals 50 and 60 to be connected to the other connection object 70;

the connection member further including:

a plurality of first conductor patterns 41 arranged in parallel to one another; and a plurality of second conductor patterns 42 intersecting the first conductor patterns and arranged in parallel to one another;

the first and the second conductor patterns 41 ad 42 being successively layered at positions different from one another;

the first conductor patterns 41 having one ends 41*a* connected to the contacts 10 and another ends 41*b* connected to one ends 42*a* of the second conductor patterns 42;

the second conductor patterns 42 having the other ends 42*b* connected to the terminals 50 and 60.

2. The connector according to exemplary embodiment 1, wherein the connection member 40 further includes:

a plurality of third conductor patterns 43 arranged in a direction same as the first conductor patterns 41 and arranged in parallel to one another; and a plurality of fourth conductor patterns 44 intersecting the third conductor patterns 43, arranged in a direction same as the second conductor patterns 42, and arranged in parallel to one another;

the first through the fourth conductor patterns 41 to 44 being successively layered at positions different from one another.

3. The connector according to exemplary embodiment 2, wherein the third conductor patterns 43 has one ends 43*a* connected to the contacts 10 and another ends 43*b* connected to one ends 44*a* of the fourth conductor patterns 44, the fourth conductor patterns 44 having another ends 44*b* connected to the terminals 50 and 60.

4. The connector according to exemplary embodiment 3, wherein the terminals 50 and 60 are arranged in three rows in a layered direction of the first through the fourth conductor patterns 41 to 44, the connection member 40 having a plurality of positioning portions 49, the positioning portions 49 positioning the terminals 60 in the center row in a pitch direction perpendicular to the layered direction.

5. The connector according to exemplary embodiment 3, wherein the first conductor patterns 41 and the third conductor patterns 43 extend in a first wiring direction and are disposed at positions different from each other in a direction perpendicular to the first wiring direction, the second and the fourth conductor patterns 42 and 44 extending in a second wiring direction and being disposed at positions different from each other in a direction perpendicular to the second wiring direction.

6. The connector according to exemplary embodiment 3, wherein at least one of the layer having the second conductor patterns 42 and the layer having the third conductor patterns 43 is provided with a ground layer 80 covering an entire area of one layer of the connection member 40, the ground layer 80 being connected to ground patterns in the first through the fourth conductor patterns 41 to 44.

7. The connector according to exemplary embodiment 1, wherein the conductor patterns between the contacts 10 and the terminals 50 and 60 are equal in length to one another.

8. The connector according to exemplary embodiment 1, further comprising a shell 30 covering the housing 20, the shell 30 including a shell terminal 30*a* to be connected to the other connection object 70.

9. The connector according to exemplary embodiment 8, wherein the shell 30 has a fitting opening for fitting to the one of the connection objects, the contacts 10 being assembled to the housing 20 to be arranged in two rows on both sides of the housing 20 at the fitting opening.

10. The connector according to exemplary embodiment 9, wherein the connection member 40 is inserted between the two rows of the contacts 10 and connected to the contacts 10.

While the invention has been particularly shown and described with reference to exemplary embodiments thereof, the invention is not limited to these embodiments. It will be understood by those of ordinary skill in the art that various changes in form and details may be made therein without departing from the spirit and scope of the present invention as defined by the claims.

What is claimed is:

1. A connector for connecting two connection objects, the connector comprising:

a plurality of contacts to be connected to one of the connection objects;

a housing holding the contacts; and a connection member coupled to the housing and including a plurality of terminals to be connected to the other connection object;

the connection member further including:

a plurality of first conductor patterns arranged in parallel to one another; and a plurality of second conductor patterns intersecting the first conductor patterns and arranged in parallel to one another;

the first and the second conductor patterns being successively layered at positions different from one another;

the first conductor patterns having one ends connected to the contacts and another ends connected to one ends of the second conductor patterns;

the second conductor patterns having the other ends connected to the terminals;

wherein the connection member further includes:

a plurality of third conductor patterns arranged in a direction same as the first conductor patterns and arranged in parallel to one another; and a plurality of fourth conductor patterns intersecting the third conductor patterns, arranged in a direction same as the second conductor patterns, and arranged in parallel to one another;

the first through the fourth conductor patterns being successively layered at positions different from one another.

2. The connector according to claim 1, wherein the conductor patterns between the contacts and the terminals are equal in length to one another.

3. The connector according to claim 1, wherein the third conductor patterns has one ends connected to the contacts and another ends connected to one ends of the fourth conductor patterns, the fourth conductor patterns having another ends connected to the terminals.

4. The connector according to claim 3, wherein the terminals are arranged in three rows in a layered direction of the first through the fourth conductor patterns, the connection member having a plurality of positioning portions, the positioning portions positioning the terminals in the center row in a pitch direction perpendicular to the layered direction.

5. The connector according to claim 3, wherein the first conductor patterns and the third conductor patterns extend in a first wiring direction and are disposed at positions different from each other in a direction perpendicular to the first wiring direction, the second and the fourth conductor patterns extending in a second wiring direction and being disposed at positions different from each other in a direction perpendicular to the second wiring direction.

6. The connector according to claim 3, wherein at least one of the layer having the second conductor patterns and the layer having the third conductor patterns is provided with a ground layer covering an entire area of one layer of the connection member, the ground layer being connected to ground patterns in the first through the fourth conductor patterns.

7. The connector according to claim 1, further comprising a shell covering the housing, the shell including a shell terminal to be connected to the other connection object.

8. The connector according to claim 7, wherein the shell has a fitting opening for fitting to the one of the connection objects, the contacts being assembled to the housing to be arranged in two rows on both sides of the housing at the fitting opening.

9. The connector according to claim 8, wherein the connection member is inserted between the two rows of the contacts and connected to the contacts.

* * * * *